US006894648B2

(12) United States Patent
Kozakai

(10) Patent No.: US 6,894,648 B2
(45) Date of Patent: May 17, 2005

(54) ANTENNA APPARATUS AND A PORTABLE WIRELESS COMMUNICATION APPARATUS USING THE SAME

(75) Inventor: Osamu Kozakai, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/814,264

(22) Filed: Mar. 21, 2001

(65) Prior Publication Data

US 2002/0000937 A1 Jan. 3, 2002

(30) Foreign Application Priority Data

Mar. 23, 2000 (JP) ..... 2000-081124

(51) Int. Cl.[7] ..... H01Q 1/24
(52) U.S. Cl. ..... 343/702; 343/895; 343/853
(58) Field of Search ..... 343/702, 700 MS, 343/895, 850, 853, 810, 820, 821, 822; H01Q 1/24

(56) References Cited

U.S. PATENT DOCUMENTS 4,072,956 A * 2/1978 Provencher ..... 343/844
4,356,492 A 10/1982 Kaloi
5,281,974 A * 1/1994 Kuramoto et al. ... 343/700 MS
5,977,916 A * 11/1999 Vannatta et al. ..... 343/702
6,175,334 B1 * 1/2001 Vannatta et al. ..... 343/702
6,198,442 B1 * 3/2001 Rutkowski et al. ..... 343/702
6,281,850 B1 8/2001 Klostermann

FOREIGN PATENT DOCUMENTS

EP 0 823 751 2/1998
GB 2 304 496 3/1997

OTHER PUBLICATIONS

Patent Abstracts of Japan vol. 1997, No. 06, (Jun. 30, 1997) & JP 09 046259 A (Matsushita Electric Ind Co Ltd), (Feb. 14, 1997).

* cited by examiner

*Primary Examiner*—Hoanganh Le
(74) *Attorney, Agent, or Firm*—Frommer Lawrence & Haug LLP; William S. Frommer

(57) ABSTRACT

An antenna apparatus featuring a simple configuration and operability at a plurality of frequencies which are relatively proximate is provided. Phase shift circuits are connected respectively between feed points of a pair of antenna elements having different resonant frequencies and a radio circuit so as to shift phase of the radio waves and to increase an impedance of one of the antenna elements when the one of the antenna elements is used at the resonant frequency of the other one of the antenna elements.

10 Claims, 16 Drawing Sheets

$$d\Phi = \frac{L}{\sqrt{\varepsilon r}} \times \frac{360}{\lambda} [\mathrm{deg}]$$

$$d\Phi = L \times \frac{360}{\lambda} [\mathrm{deg}]$$

$$d\Phi = \frac{L}{\sqrt{\varepsilon eff}} \times \frac{360}{\lambda} [deg]$$

ANTENNA APPARATUS AND A PORTABLE WIRELESS COMMUNICATION APPARATUS USING THE SAME

BACKGROUND OF THE INVENTION

1. Field of the Invention

The present invention relates to an antenna apparatus for transmitting or receiving radio waves in two or more frequency bands, and in particular, to an antenna apparatus capable of being installed in a portable wireless communication apparatus such as a portable telephone.

2. Description of the Related Art

Recently, portable telephones are rapidly proliferating, and a demand for use with a broader frequency band is increasing so as to improve transmission efficiency and prevent a noise as well as interference in the portable telephone. Because an antenna construction of a conventional portable telephone does not allow to be used with a wide frequency band, developments of new antenna apparatus and methods, which are operable at a plurality of frequencies, and able to realize a broader band wireless transmission and reception, are in progress.

FIGS. 1 and 2 show examples of antennae which are operable in a plurality of frequency bands. FIG. 1 shows such an example using a parasitic antenna element, and FIG. 2 shows such an example using a plurality of radiating conductors.

In an antenna 180 shown in FIG. 1, a coaxial line 181 is connected to a dielectric substrate 182. In this dielectric substrate 182, a radiating conductor element 183 and a parasitic element 184 are disposed in proximity. This arrangement is widely used for obtaining a multiple resonant characteristic. Further, in an antenna 190 shown in FIG. 2, where no parasitic antenna element 184 is used, a plurality of radiating conductor elements 192 and 193 each having a different resonance frequency is arrayed on a substrate 191, and they are supplied with power from single feed point 194 to obtain a multiple resonant characteristic. By way of example, the antenna 190 is grounded at a ground point 195.

The antenna 180 having the parasitic antenna element disposed therein as shown in FIG. 1 involves such a problem that a discretionary arrangement of antenna elements is impossible because that a relationship in positions between the parasitic antenna element 194 and the radiating element 193 has a significant influence on a characteristic impedance of its antenna apparatus.

Also, in the antenna 190 shown in FIG. 2, in which no parasitic antenna element is disposed, there is required a large space for accommodating the radiating elements 192 and 193 arrayed therein which resonate in a plurality of frequency bands. In addition, this type of antenna has such a problem that the antenna may not be operable if these frequency bands are in proximity and overlap by approximately 10%. This is because that in such an arrangement as of the antenna 190, a multiple resonant of respective radiating conductors 192 and 193 is realized by spacing apart therebetween by means of a slit and operating them at respective resonant frequencies. However, because of a certain degree of broad band characteristic owned by respective radiating conductors 192 and 193, if their frequency bands are in close proximity, the effect by the slit to space apart therebetween and the multiple resonant are not attained. Despite of the above, it is required to be operable at frequencies which are in proximity for use in the aforementioned portable telephone.

SUMMARY OF THE INVENTION

The present invention has been contemplated to solve the aforementioned problems associated with the related art. An object of the invention is to provide an antenna apparatus which has a simple configuration and is operable at a plurality of proximate frequencies.

Another object of the invention is to provide a portable wireless telephone which has simple configuration and is operable at a plurality of frequencies which are relatively proximate.

In order to accomplish the aforementioned objects of the invention, an antenna apparatus capable of transmitting and/or receiving radio waves at two frequencies is provided, in which feed points of two antenna elements having different resonant frequencies are connected to a radio circuit via two phase shift circuits which shift phases of radio waves.

In this antenna apparatus according to the present invention, because the antenna elements are connected to the feed point via respective phase shift circuits, an impedance characteristic of one antenna element at the resonance frequency of the other antenna element is adjusted so as to eliminate adverse influences between these antenna elements, thereby enabling operation at two frequencies which are relatively in close proximity, by use of the antenna apparatus which is realized in a simple configuration.

Further, according to the present invention, a portable communication apparatus is provided for receiving and/or transmitting radio waves at a plurality of frequencies, which portable communication apparatus is comprised of two antenna elements each having a different resonance frequency, and two phase shift circuits for changing phases of radio waves, wherein the feed points of the two antenna elements are connected to a radio circuit via the phase shift circuits respectively.

In such a portable wireless communication apparatus, because the antenna elements are connected to the feed point via respective phase shift circuits, an impedance characteristic of one antenna element at a resonance frequency of the other antenna element is adjusted to eliminate adverse influences between these antenna elements, thereby enabling reception and/or transmission of radio waves at different frequencies which are relatively in close proximity, by use of the antenna apparatus realized in a simple configuration.

DETAILED DESCRIPTION OF THE PREFERRED EMBODIMENTS

A preferred embodiment of the present invention will now be described with reference to accompanying drawings. In the following description, features of the present invention will be described, unless otherwise described, by way of example of those obtained in wireless transmission. However, it is not limited thereto, and the same features should be construed to be obtained in wireless reception because of a reversible relationship between reception and transmission of radio waves.

Figure 1:
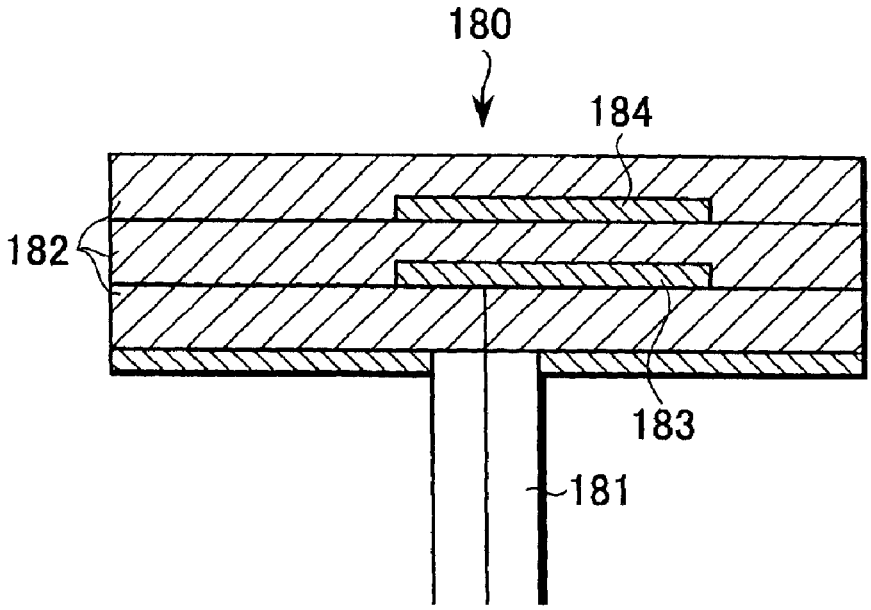
FIG. 1 is a diagram showing an example of antenna using a parasitic antenna element, which is operable at a plurality of frequencies.
Figure 2:
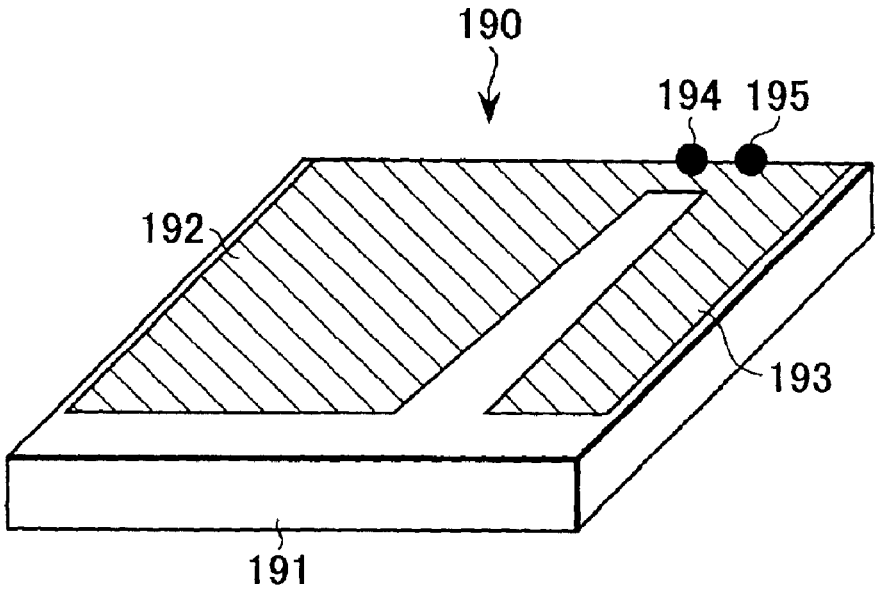
FIG. 2 is a diagram showing an example of antennae using a plurality of radiating conductors, which is operable at a plurality of frequencies.
Figure 3:
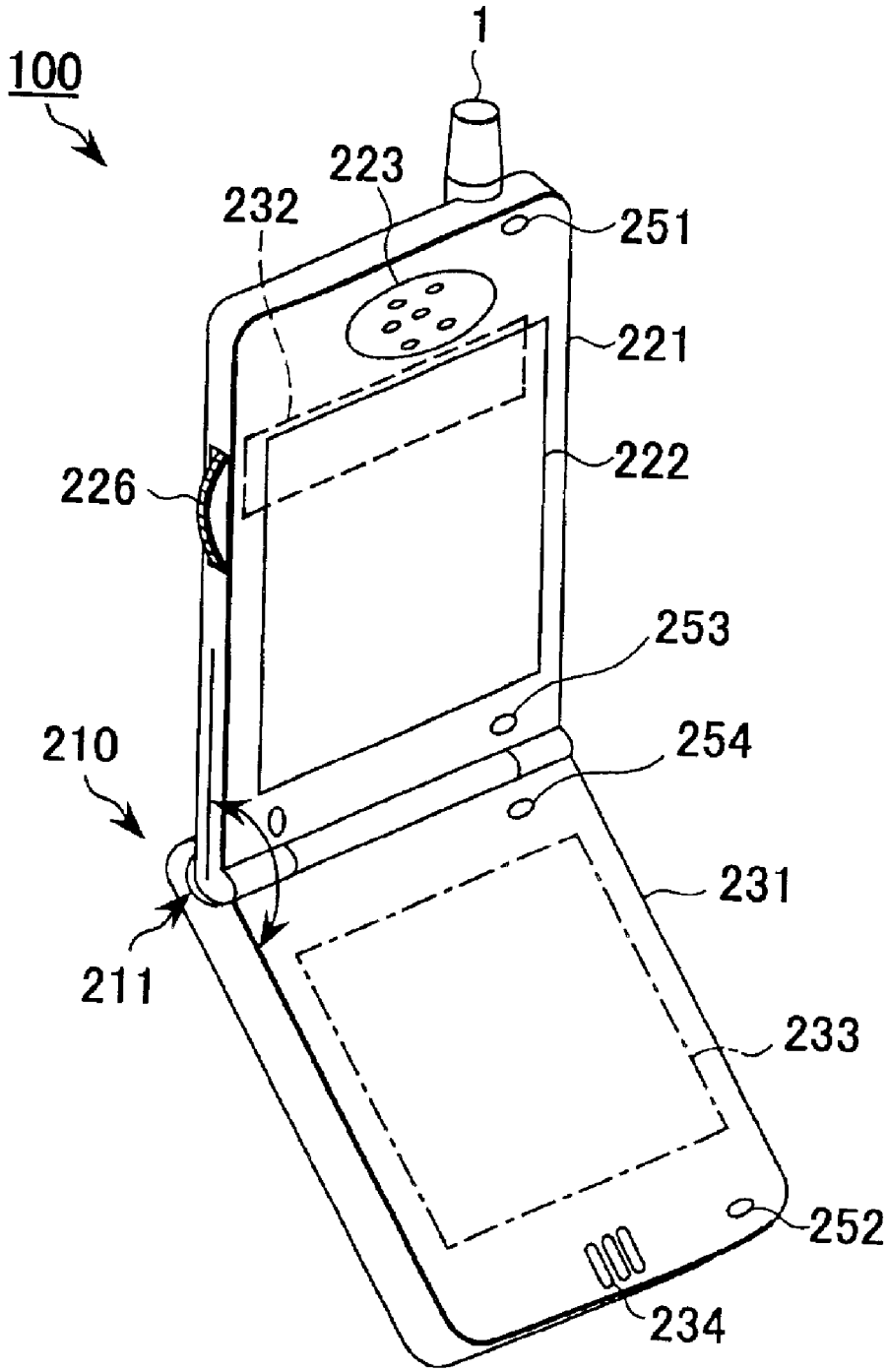
FIG. 3 is a diagram showing an appearance of an example of portable telephones to which an antenna apparatus of the present invention is applicable.

FIG. 3 is a diagram showing an overview of an example of a portable telephone to which an antenna apparatus of the present invention may be applicable. The portable telephone 100 of the present example comprises an folding body 210 including a first housing 221, a second housing 231 and a hinge 211. In the first housing 221, an antenna 1, a speaker 223, an external LCD 232, a jog dial 226 and an internal LCD 222 are mounted. In the second housing, an operation key unit 233 and microphone 234 are mounted. Further, the portable telephone 100 comprises an open/close-state sensing switch 251 and a protrusion part 252 for detecting an open/close state of the folding body 210, and a closed state sensing switch 253 and a magnet part 254 for detecting a closed state of the holding body 210.

Figure 4:
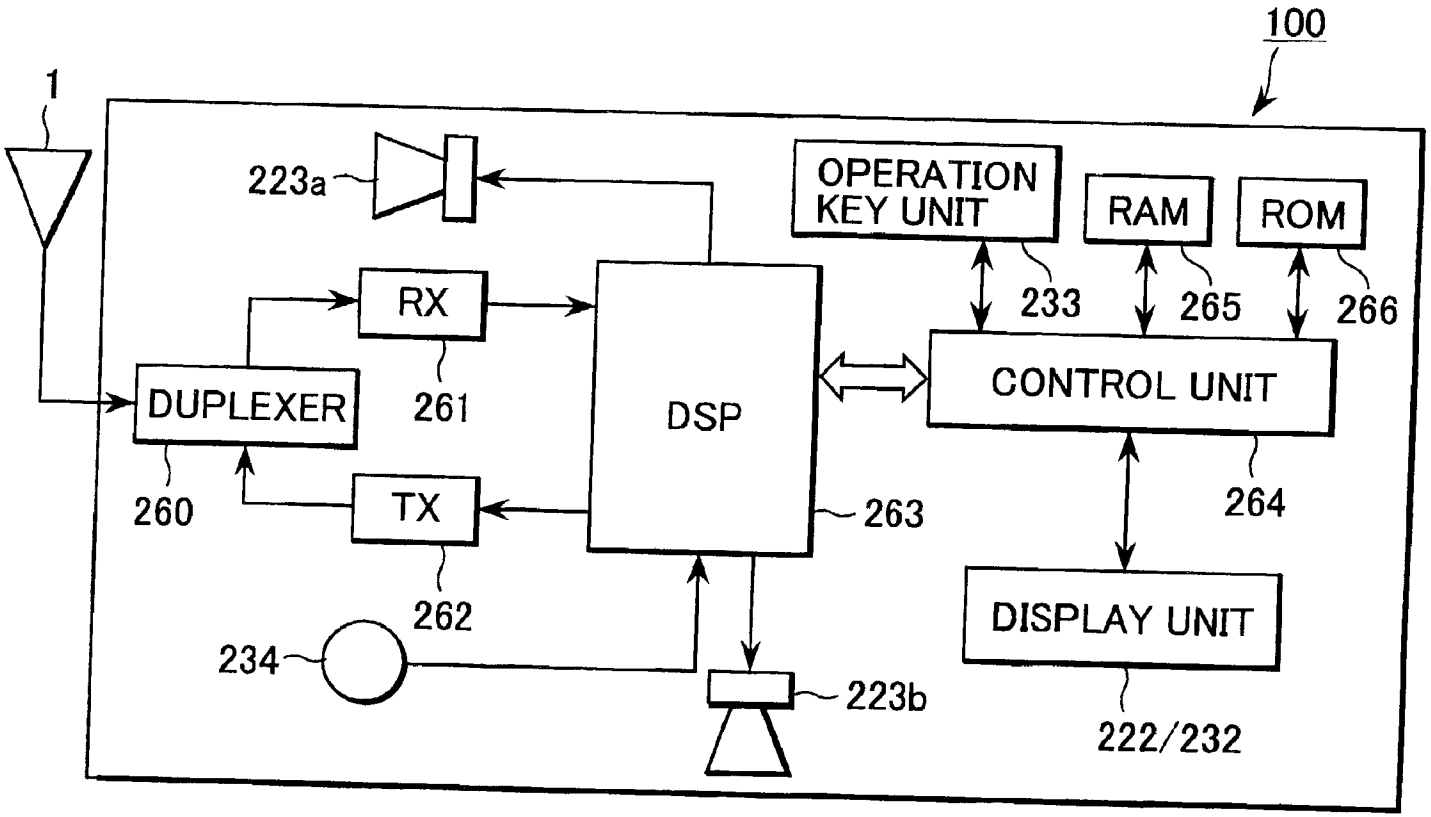
FIG. 4 is a schematic block diagram showing an internal arrangement of the portable telephone of FIG. 3.

FIG. 4 is a schematic block diagram showing an example of an internal arrangement of the portable telephone of FIG. 3. The same notations are used in FIG. 4 as that of FIG. 3 for parts performing same functions. In addition to the above-mentioned parts, the portable telephone 100 of the present example further comprises a duplex unit 260, a receiving unit 261, a transmitting unit 262, a digital signal processing unit (DSP) 263, a control unit 264, RAM 265 and ROM 266.

Figure 5:
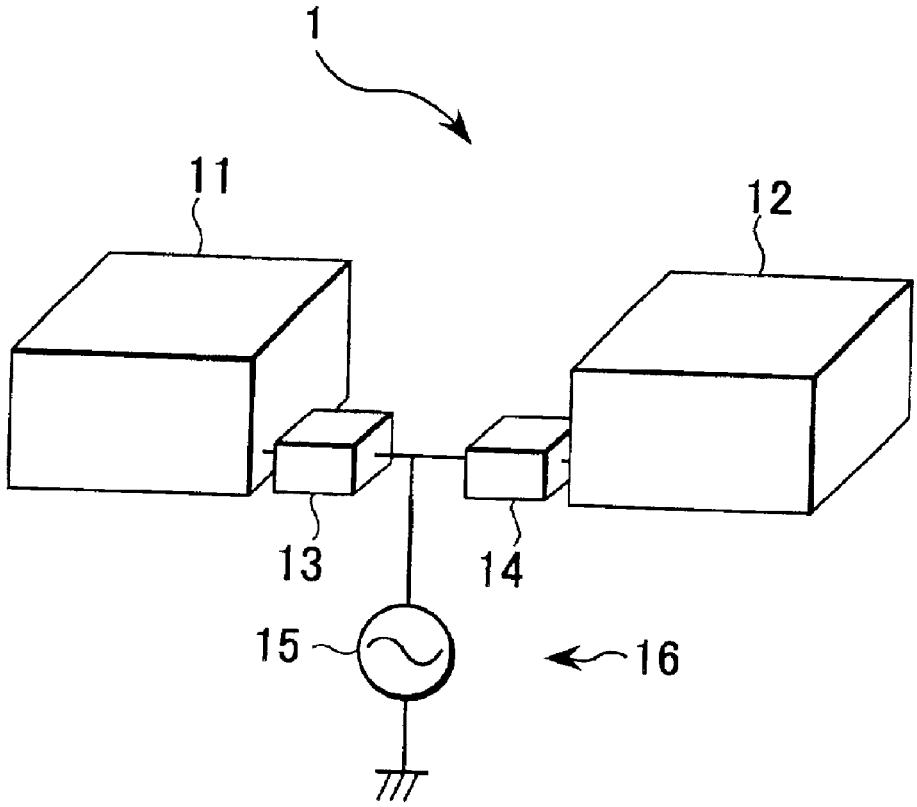
FIG. 5 is a schematic block diagram indicating main portions of an antenna apparatus of the present invention.

FIG. 5 schematically shows principle portions of an antenna apparatus in accordance with an embodiment of the present invention. An antenna apparatus 1 of the present embodiment, which transmits radio waves of two different wavelengths using two antenna elements having different resonance frequencies, may be used for a portable wireless communication apparatus such as a portable wireless telephone. However, the present invention is not limited to the present embodiment, and may be applicable to any other types of wireless apparatus using radio waves to transmit and/or receive signal as well.

In the antenna apparatus 1, two antenna elements 11 and 12 having resonance frequencies different from each other are coupled to phase shift circuits 13 and 14 respectively at respective feed points, and to a radio circuit including an oscillator 15 for generating radio waves of two predetermined wavelengths. A power generated by oscillator 15 is simply branched and distributed to antenna elements 11 and 12 via phase shift circuits 13 and 14 respectively. The phase shift circuits 13 and 14 are comprised of a lumped circuit or a distributed constant circuit.

Assuming that a resonance frequency of the antenna element 11 is f1 and a resonance frequency of the antenna element 12 is f2, the phase shift circuit 13 coupled to the antenna element 11 shifts phase of radio waves of the resonance frequency f2 by a prescribed quantity, and also the phase shift circuit 14 coupled to the antenna element 12 shifts phase of radio waves of the resonance frequency f1 by a prescribed quantity. Namely, respective antenna elements 11 and 12 are designed to have impedance matching at their own resonance frequencies f1 and f2, by arranging such that respective phase shift circuits 13 and 14 shift phases of radio waves by prescribed quantities which are experimentally determined so as to ensure not to be operable even when radio waves of the other resonance frequencies f2 or f1 different from its own resonance frequency is supplied. In other words, each antenna element 11 and 12 of the pair is operable at a time that is independent of the other.

Figure 6A:
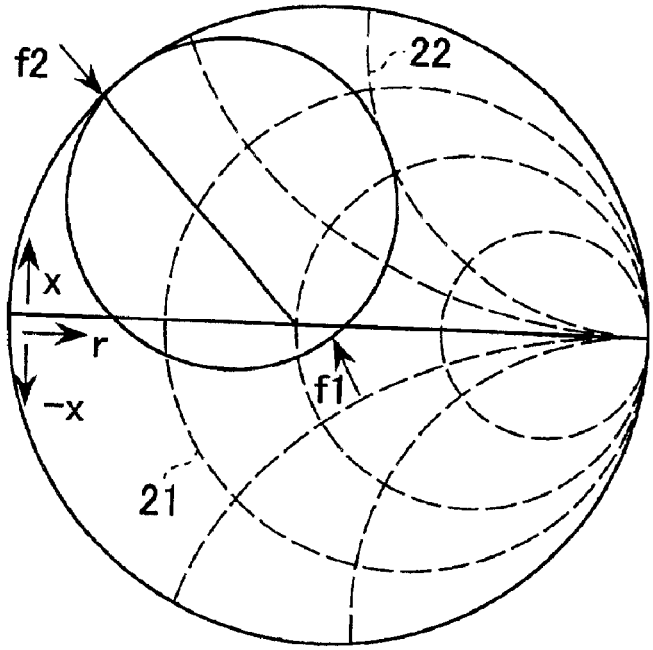
FIGS. 6A and 6B are Smith charts indicating examples of input impedance characteristics of an antenna element having a resonance frequency of f1, wherein FIG. 6A indicates an instance without connecting a phase shift circuit while FIG. 6B indicates an instance with a phase shift circuit connected.
Figure 6B:
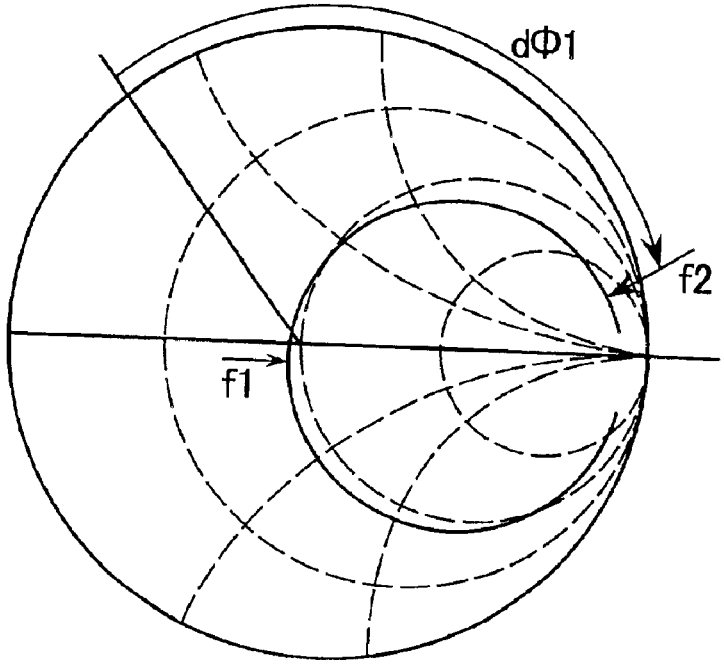

Set-up of the prescribed phase shift quantity will be described using a Smith chart. FIGS. 6A and 6B show Smith charts depicting input impedance characteristics of antenna element 11, where FIG. 6A depicts an instance without connecting the phase shift circuit 13, and FIG. 6B an instance with the phase shift circuit 13 connected. Further, FIGS. 7A and 7B show Smith charts depicting input impedance characteristics of the antenna element 12, where FIG. 7A depicts an instance without connecting the phase shift circuit 14, and FIG. 7B an instance with the phase shift circuit 14 connected.

In these Smith charts, where a circuit characteristic impedance of 50 ohms normalizes its input impedance, a real part of the normalized impedance is indicated, for example, in FIG. 6A by a resistance line 21, and an imaginary part thereof by a reactance line 22 respectively. Further, in these Smith charts, input impedance characteristics are shown as recorded by a circular locus when the frequency of input radio waves is shifted, i.e., when the frequency is increased clockwise.

An input impedance characteristic for the antenna element 11 alone is denoted by resonance frequency f1 indicated by an arrow in FIG. 6A which is approximately in the center portion on the chart, thereby indicating to be in a matched impedance state at f1. A state shifted by a phase shift quantity dϕ1 from the above state by means of the phase shift circuit 13 is depicted in FIG. 6B, where the position of f2 is shown as rotated by the phase shift quantity dϕ1 on the chart while the position of f1 unchanged. Namely, from FIG. 6B, it is known that by means of the phase shift circuit 13, while maintaining the matching state at frequency f1 for the input wave, an input impedance at f2 is increased sufficiently compared with that at f1, and its phase shift quantity dϕ1 is set appropriately so that antenna element 11 will not operate at f2.

Figure 7A:
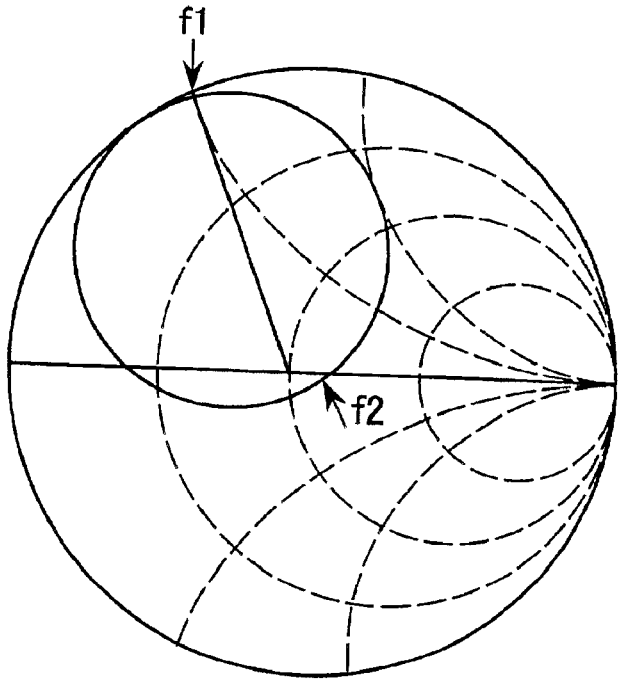
FIGS. 7A and 7B are Smith charts indicating examples of input impedance characteristics of another antenna element having a resonance frequency of f2, wherein FIG. 7A indicates an instance without connecting a phase shift circuit while FIG. 7B indicates an instance with a phase shift circuit connected.
Figure 7B:
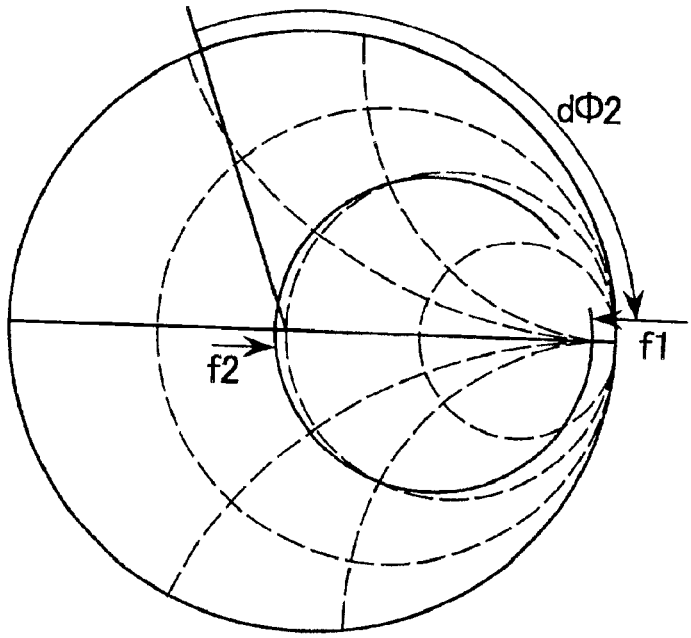

Likewise in FIG. 7A, a matching state is obtained at resonance frequency f2 for the antenna element 12. However, in FIG. 7B, where the position of f1 is indicated as rotated by a phase shift quantity dϕ2 without changing the position of f2 on the chart, it is known that by means of the phase shift circuit 14, its phase shift quantity dϕ2 is set appropriately so that an input impedance at f1 becomes sufficiently high while maintaining the matching state at frequency f2 for the input wave.

As described above, by phase shifting with the phase shift circuit, the input impedance of the antenna element at the resonance frequency of the other antenna element in proximity is increased substantially, thereby minimizing mutual RF interference at respective operating frequencies of the proximate antenna elements, and thereby enabling to provide the antenna apparatus of the present invention which is operable at two different frequencies, and which may be implemented in a simple construction to array plural antennae in parallel connection.

Figure 8:
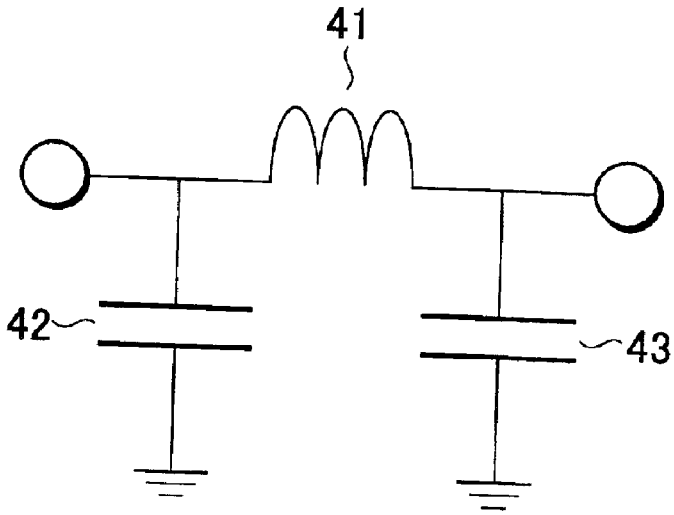
FIG. 8 shows an example of the phase shift circuit comprising a lumped circuit, and which indicates a phase shift circuit for realizing a positive quantity of phase shift.
Figure 9:
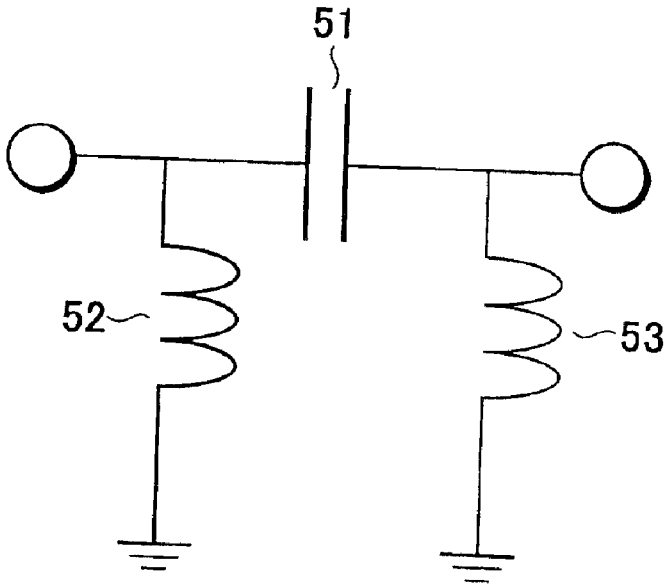
FIG. 9 shows an example of the phase shift circuit comprising a lumped circuit, and which indicates a phase shift circuit for realizing a negative quantity of phase shift.
Figure 10:
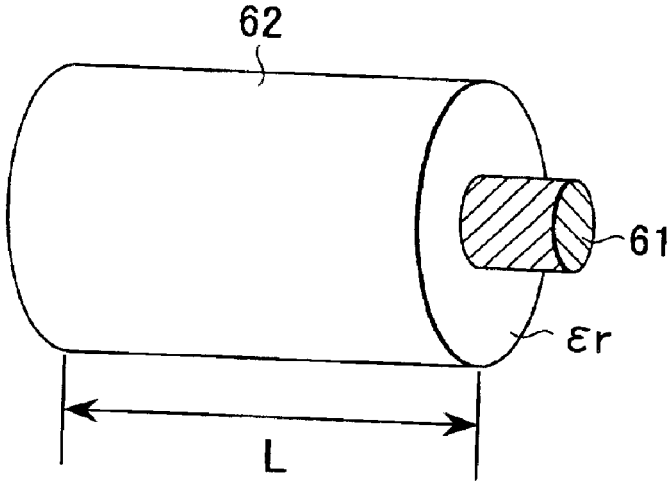
FIG. 10 is an example of the phase shift circuit comprising a distributed constant circuit, and which indicates a coaxial line.
Figure 11:
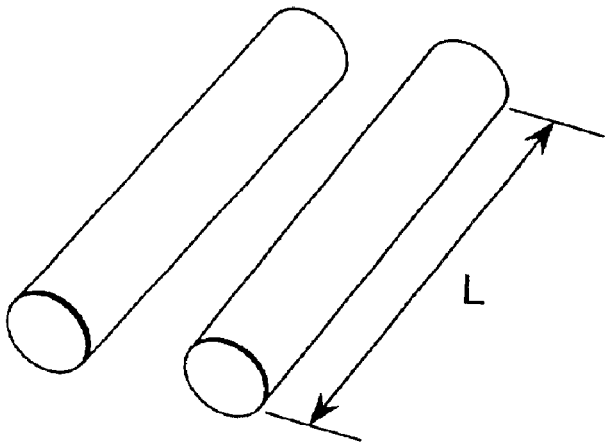
FIG. 11 is an example of the phase shift circuit comprising a distributed constant circuit, and which indicates a parallel twin line.
Figure 12:
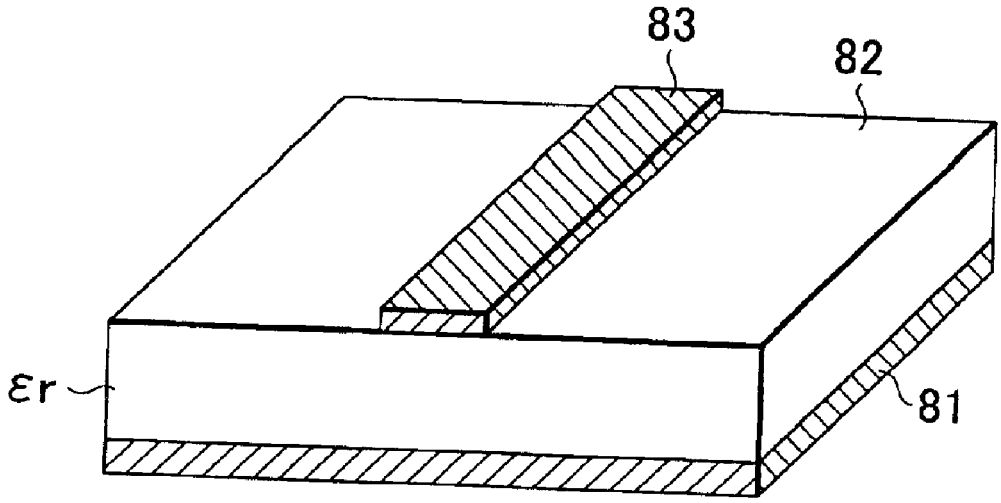
FIG. 12 is an example of the phase shift circuit comprising a distributed constant circuit, and which indicates a micro-strip line.

Now, examples of the phase shift circuits for use in the aforementioned antenna apparatus 1 will be described in the following. FIGS. 8 and 9 show examples of the phase shift circuits comprising a lumped circuit. FIG. 8 is a phase shift circuit which realizes a positive (+) phase shift quantity. FIG. 9 is a phase shift circuit which realizes a negative (−) phase shift quantity. Further, FIGS. 10, 11 and 12 show examples of phase shift circuits comprising a distributed constant circuit. FIG. 10 is a coaxial line, FIG. 11 is a parallel twin line, and FIG. 12 is a micro-strip line.

An example of the phase shift circuits comprising a lumped circuit is shown in FIG. 8, where an inductance 41 is connected in series, and capacitors 42 and 43 are connected in parallel. Here, when we consider a change of phase shift on the Smith chart of FIG. 6A for an instance where inductance 41 inserted in series, a locus of impedance characteristics thereon is moved clockwise along the resistance line 21. Further, when we assume a conductance line (not shown) which is drawn symmetrically relative to the resistance line 21 on the chart (immittance chart), and when the capacitors 42 and 43 are inserted in parallel, a locus thereof is moved clockwise along the conductance line. Accordingly, by use of this phase shift circuit, the phase of input waves is shifted to a positive direction.

Further, in FIG. 9, a capacitor 51 is connected in series, and inductors 52 and 53 are connected in parallel. Referring to the Smith chart, if the capacitor 51 is inserted in series, the locus thereof is moved counter-clockwise along the resistance line 21. Still further, if the inductors 52 and 53 are inserted in parallel, the locus thereof is moved counter-clockwise along the conductance line. Accordingly, by means of this phase shift circuit, the phase of input waves is moved to a negative direction.

On the other hand, the distributed constant circuit implemented as the phase shift circuit may include the coaxial line of FIG. 10, the parallel twin line of FIG. 11, the micro-strip line of FIG. 12 and the like. The coaxial line of FIG. 10 comprises an internal conductor 61, an external conductor which is not shown, and a dielectric member 62 for supporting the external conductor. Generally, a braided wire is used as the external conductor, a single or stranded wire is used as the internal conductor 61, and polyethylene or the like is used as the dielectric member 62. The parallel twin line shown in FIG. 11 which is used widely as a feeder line for transmission and reception of a short wave band and for television waves, has a simple structure and a low cost to manufacture. However, because of an internal radiation between its parallel twin lines, there occur a very large inductive interference and radiation loss in comparison with those of the coaxial line. The micro-strip line of FIG. 12 comprises a plane conductor 81, a dielectric member 82 mounted thereon and a conductor 83.

In FIGS. 10, 11 and 12, equations for obtaining a phase shift quantity dϕ resulted by transmitting through respective phase shift circuits are given. As depicted in these equations, the phase of signal after it is transmitted through these distributed constant circuits is shifted by a change in a physical length L of their lines. A relationship between a physical length of its circuit and an electrical length within its circuit changes depending on a diameter, a thickness, and a specific dielectric constant ∈Γ of its line. However, as for the effect for shifting the phase, any of these circuits can be used for this purpose. Further, in consideration of advantages in terms of ease of mounting on a substrate as well as of a low cost in manufacture, the micro-strip line is considered most preferable as a phase shift circuit for use in the portable communication apparatus.

Figure 13:
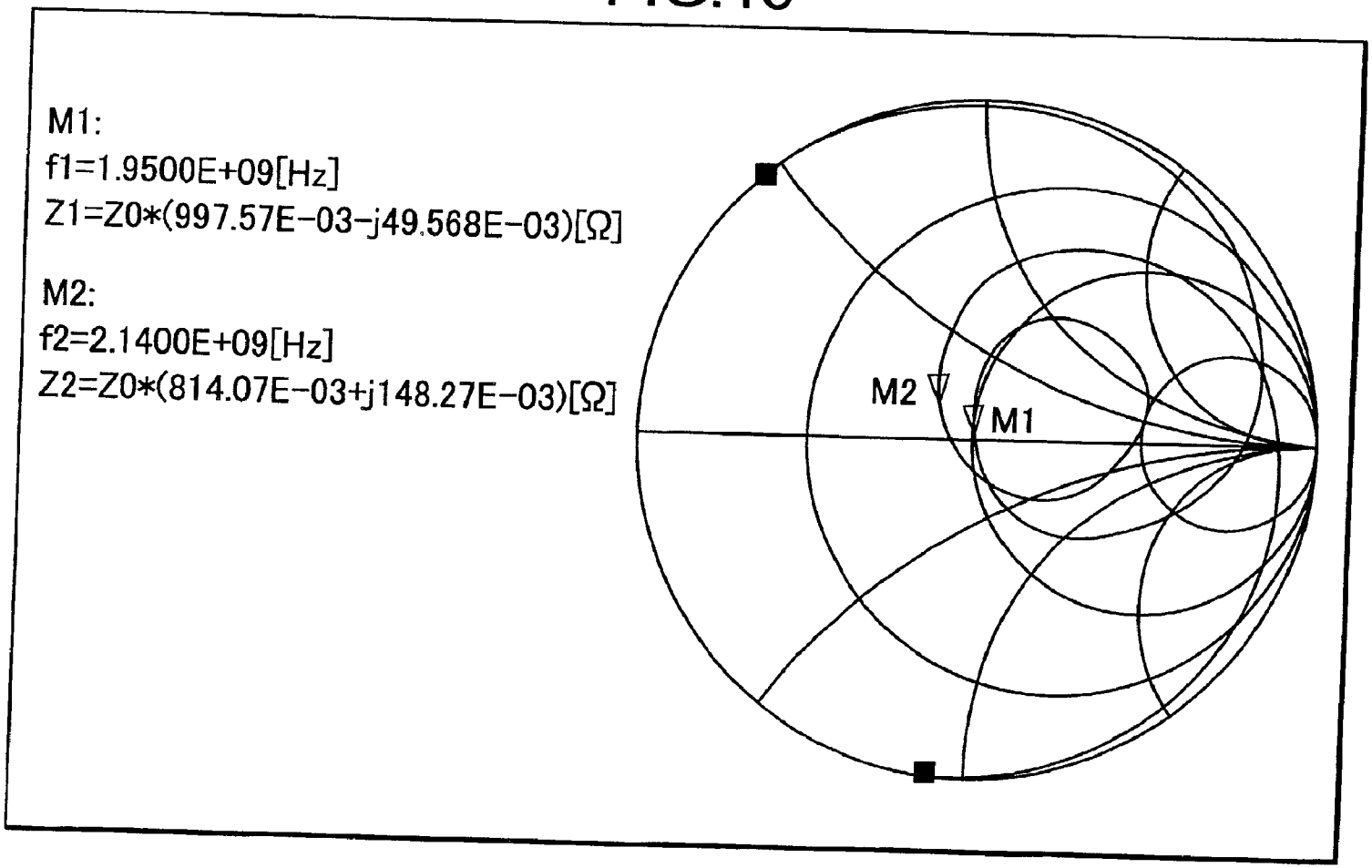
FIG. 13 is a Smith chart depicting an input impedance characteristic when a phase shift circuit is connected.
Figure 14:
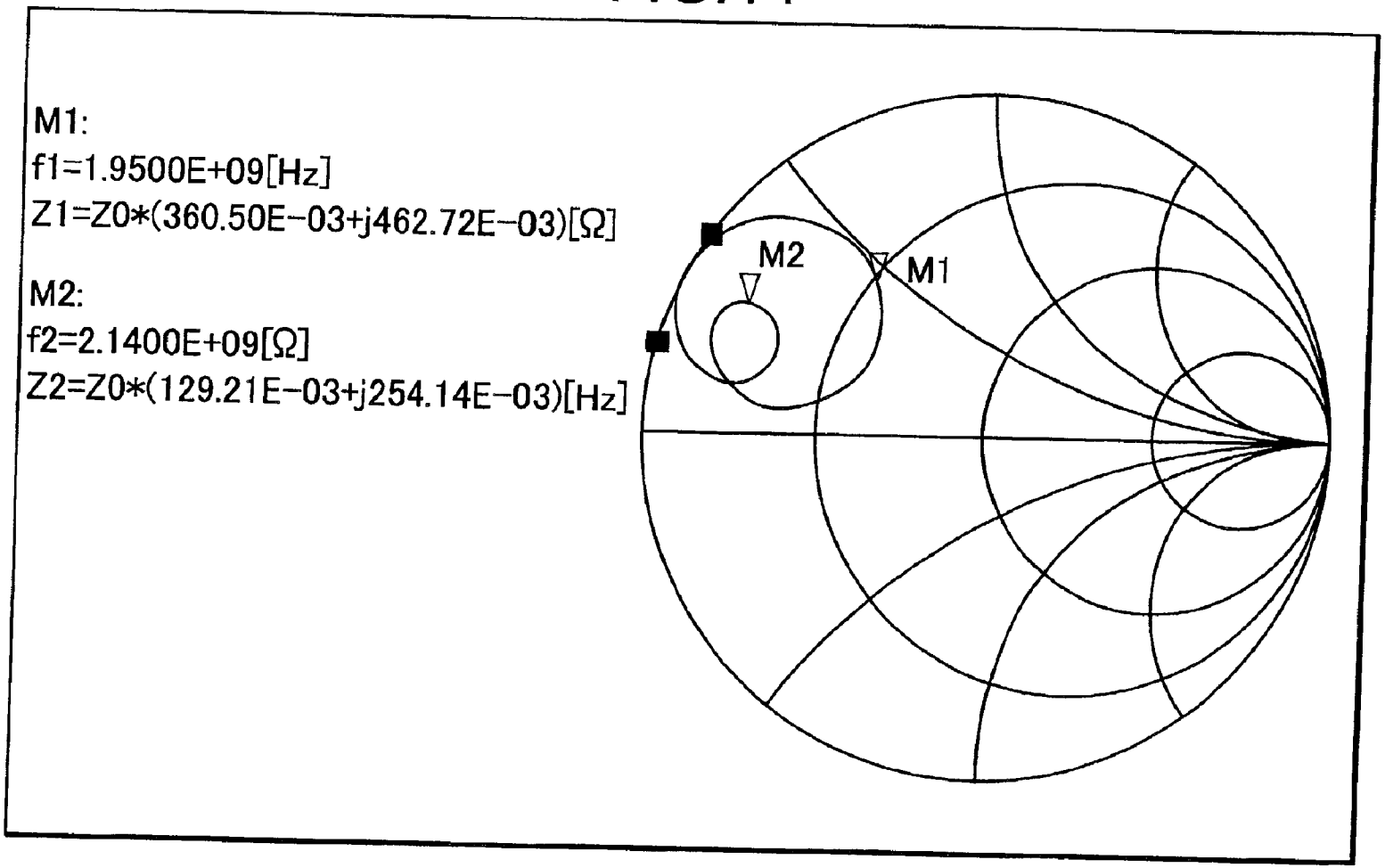
FIG. 14 is a Smith chart depicting an input impedance characteristic when a phase shift circuit is not connected.
Figure 15:
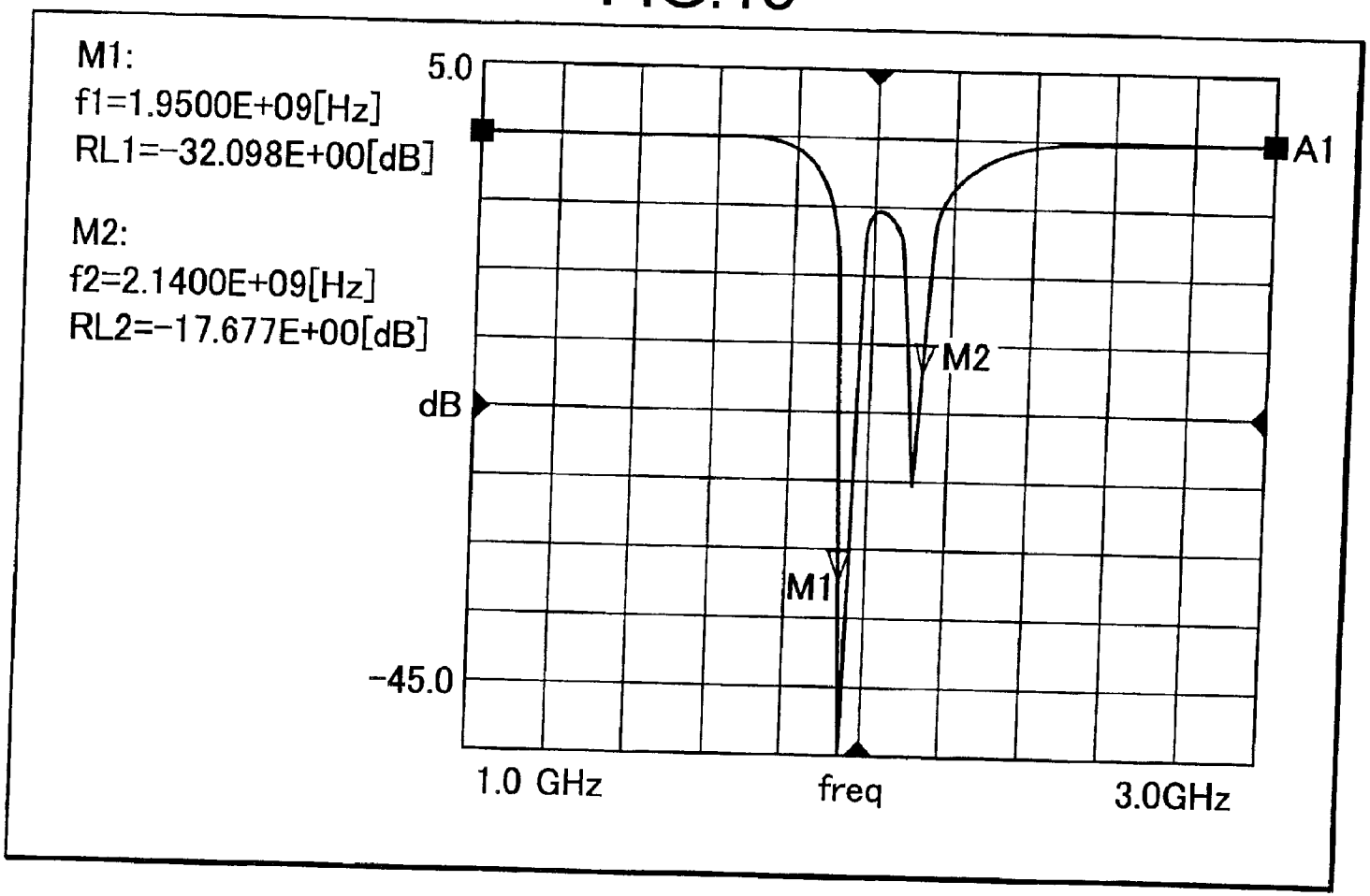
FIG. 15 is a diagram depicting a return-loss characteristic when a phase shift circuit is connected.
Figure 16:
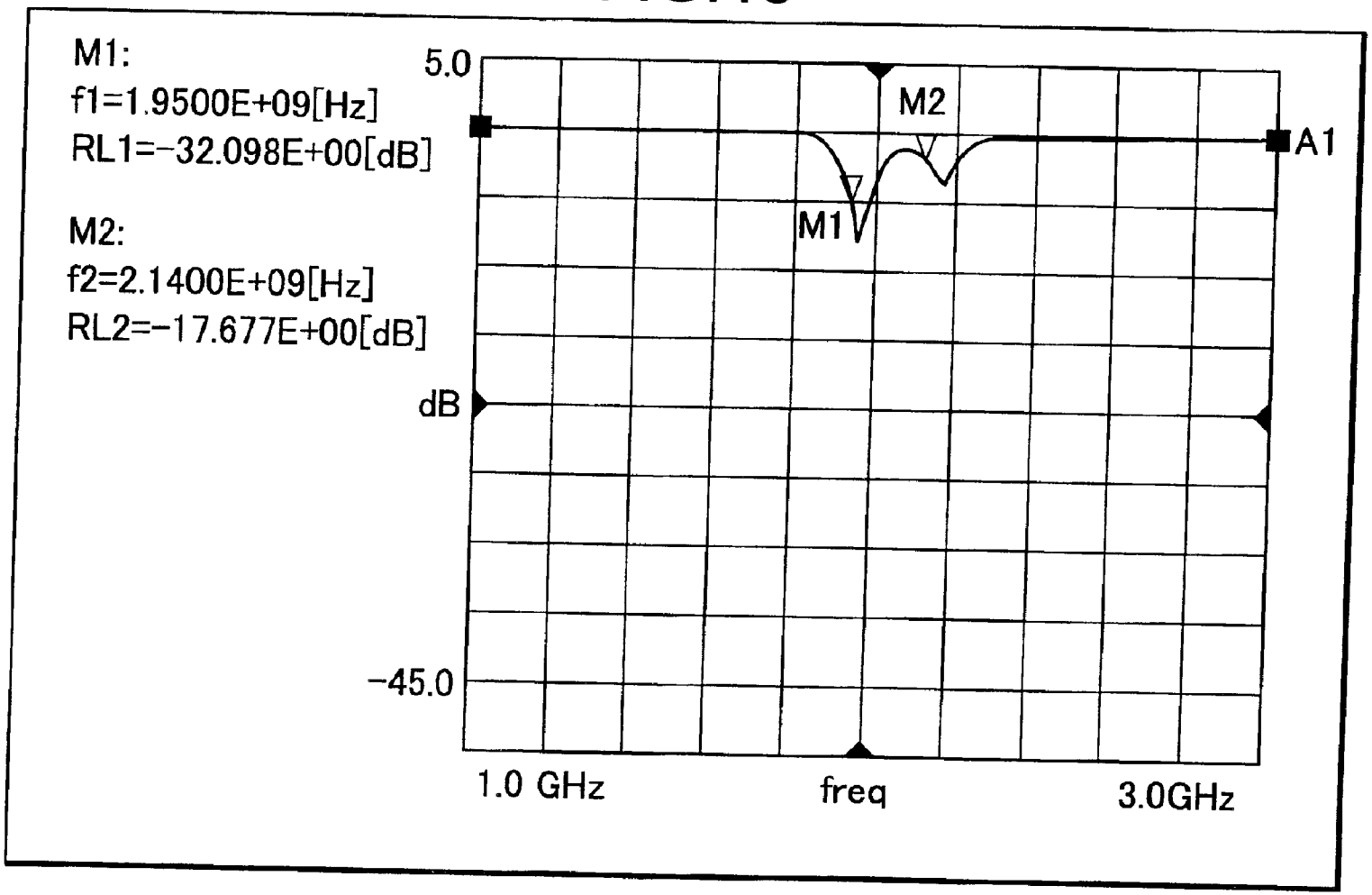
FIG. 16 is a diagram depicting a return-loss characteristic when a phase shift circuit is not connected.

In the next, examples of calculations of a total impedance characteristic of the antenna elements 11 and 12 combined together as well as of return-loss characteristics which were obtained by circuit simulation respectively will be described with reference to FIGS. 13 and 14, as well as with reference to FIGS. 15 and 16, respectively. FIG. 13 shows an input impedance characteristic where the phase shift circuits 13 and 14 are connected whereas FIG. 14 shows an input impedance characteristic where the phase shift circuits 13 and 14 are not connected. Further, FIG. 15 shows a return-loss characteristic where the phase shift circuits 13 and 14 are connected whereas FIG. 16 shows a return-loss characteristic where the phase shift circuits 13 and 14 are not connected.

By way of example, in respective circuit simulations of FIGS. 13, 14, 15 and 16, the distributed constant circuit was used as the phase shift circuit, and respective impedance characteristics were recorded while the frequency was changed from 1 GHz to 3 GHz. Resonance frequencies f1 and f2 of the antenna elements 11 and 12 are set at 1.95 GHz and 2.14 GHz, respectively. Respective points of measurement at these frequencies are depicted as M1 and M2 respectively on the charts, and values of input impedance measured at M1 and M2 are denoted by Z1 and Z2, and also values of return-losses measured are denoted by RL1 and RL2 respectively.

With reference to FIG. 13, with respect to frequency f1 or f2, M1 or M2 is approximately in the center portion on the chart thereby indicating an impedance matching at this frequency. Further, with reference to FIG. 15, it is clearly shown that in portions other than at f1 or f2, a loss increases substantially. In FIG. 14, however, a mismatching at each operational frequency is shown. In FIG. 16, a large loss at each operational frequency is shown. Thereby, it is known that by provision of the phase shift circuits 13 and 14, adverse interference between antenna elements is suppressed, and an excellent two-frequency operation characteristic is obtained. As described above, the antenna apparatus 1 in accordance with the present embodiment of the present invention has an excellent operational characteristic even when two proximate frequencies are in use despite its simple construction. Further, it should be noted that it is also possible to make two remote frequencies which are discretionary selected to be operable in the same antenna arrangement described above.

Furthermore, in the antenna apparatus 1 described above, the same operation as described above may be obtained in view of the theoretical principle of the antenna even when a phase shift quantity of $n\lambda/2$ (where $\lambda$ is a wavelength of an operational frequency of a proximate antenna element, and n is an integer) is added to the phase shift quantity determined above by means of the phase shift circuit. This is also clear from the fact that in FIGS. 6B and 7B, where one turn of scales around the outer circumference of its Smith charts corresponds to ½ of its wavelength, one rotation around the measurement line on the chart returns to its original position on the chart. In an actual circuit, however, available frequency bands may be more limited as a value of $|n|$ increases because of shortcomings such as increasing loss with higher $|n|$ value. Accordingly, it is preferable to minimize the value of n.

In the foregoing description of the present invention, the antenna apparatus having two antenna elements have been explained, however, it is not limited thereto, and it is also possible to realize an antenna apparatus which is operable at a plurality of frequencies by using more than two antenna elements, and connecting in parallel such antenna elements via respective phase shift circuits to its radio circuit. Frequency characteristics of these antenna elements and those of the phase shift circuits determine the number of frequencies operable in this antenna apparatus 1, and there is basically no limitation in the number of operable frequencies. In practice, however, the number of operable frequencies may be limited up to approximately four. For example, in such antenna equipment, a frequency of interest to be handled by the phase shift circuit connected to a given antenna element will have to be selected from operational frequencies belonging to the other antenna elements. Accordingly, good impedance characteristic is not always ensured to be obtained at any operational frequencies other than the one corresponding to the respective phase shift circuit, and it may be considered that the operable frequency itself is limited.

Figure 17:
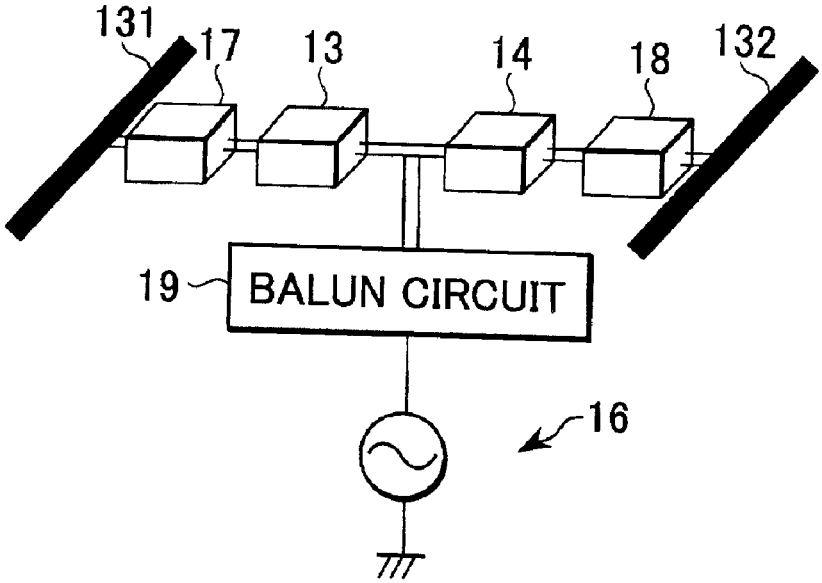
FIG. 17 is a diagram showing a dipole antenna as an example applicable to the antenna apparatus of the present invention.

Further, with reference to FIGS. 17, 18, 19, 20 and 21, some examples of the antenna elements applicable to the antenna equipment in accordance with the embodiment of the present invention are shown. FIG. 17 shows a dipole antenna, FIG. 18 a loop antenna, FIG. 19 a plane inverted F pattern antenna, FIG. 20 an inverted L pattern antenna, and FIG. 21 a helical antenna, respectively.

In the case of FIG. 17 using the dipole antenna, assuming a wavelength of its resonance frequency to be $\lambda$, lengths of dipole antennae 131 and 132 are normally selected to be $\lambda/2$. When their antenna lengths are desired to be shortened, a matching circuit 17 and 18 are connected between each antenna element and its phase shift circuits 13 and 14 respectively in order to avoid a probable mismatching due to shortened length of the dipole antenna. Further, because that the radio circuit 16 is normally an unbalanced circuit with one end of the circuit grounded whereas the dipole antenna is a balanced antenna, if they are coupled directly, an unbalanced current will flow therebetween thereby causing a power loss. Therefore, a balanced-to-unbalanced transformer (Balun) 19 is required to be connected therebetween. A whip antenna of a front end feed type which is one of the aforementioned dipole antennas is widely used for vehicle communication and portable communication apparatus. The antenna apparatus of the present invention is, therefore, desirable as antenna elements to be mounted in these wireless communication apparatus.

Figure 18:
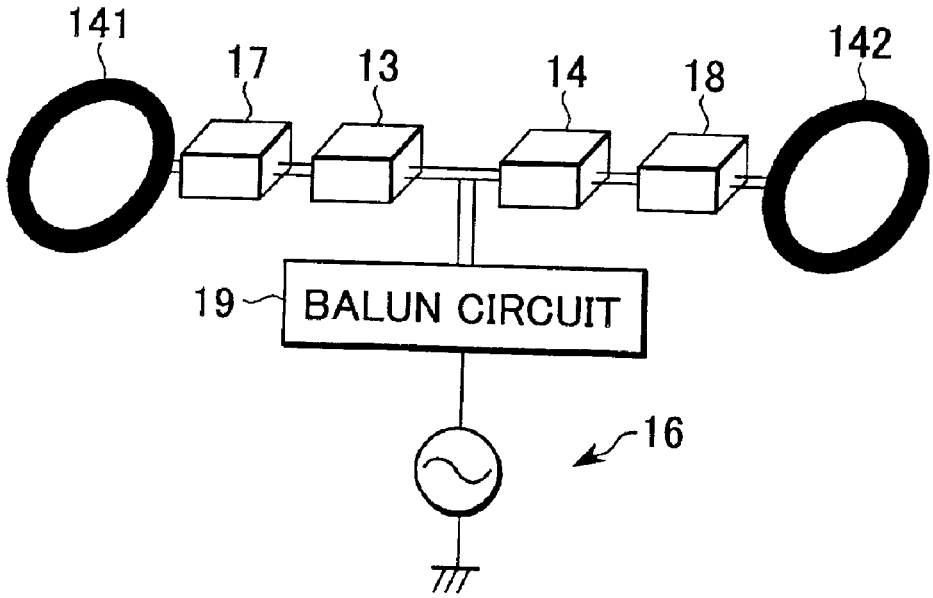
FIG. 18 is a diagram showing a loop antenna as an example applicable to the antenna apparatus of the present invention.

As for loop antennae 141 and 142 shown in FIG. 18, its loop diameter is normally selected to be less than one wavelength of the frequency of radio waves, and if a large impedance mismatching exists, the matching circuits 17 or 18 is connected between each antenna element and its phase shift circuits 13 or 14, respectively. Further, because that the loop antenna is a balanced antenna, a Balun circuit 19 needs to be connected between the antennae and the radio circuit 16.

Figure 19:
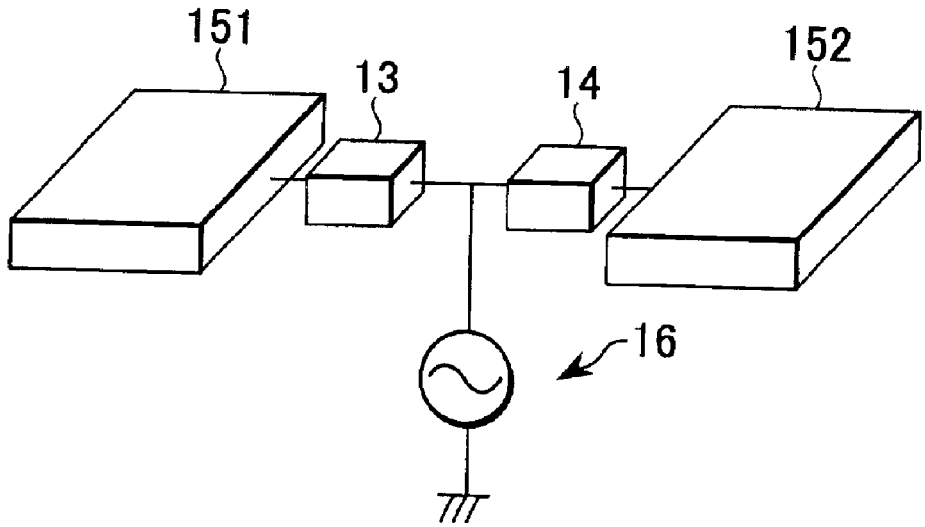
FIG. 19 is a diagram showing a plane inverted F pattern antenna as an example applicable to the antenna apparatus of the present invention.

Plane inverted F pattern antennae 151 and 152 shown in FIG. 19 are unbalanced antennae, therefore, the connection of the Balun circuit is not necessary, thereby allowing a direct coupling of the radio circuit 16 and the phase shift circuits 13 and 14. There is no need of connection of a matching circuit because of a capability of self-matching by the antennae themselves. This type of plane inverted F pattern antennae or its modified antenna elements are used as a built-in antenna for a portable telephone, therefore, the antenna apparatus of the present invention is preferable for use as antenna elements to be installed in the portable telephone.

Figure 20:
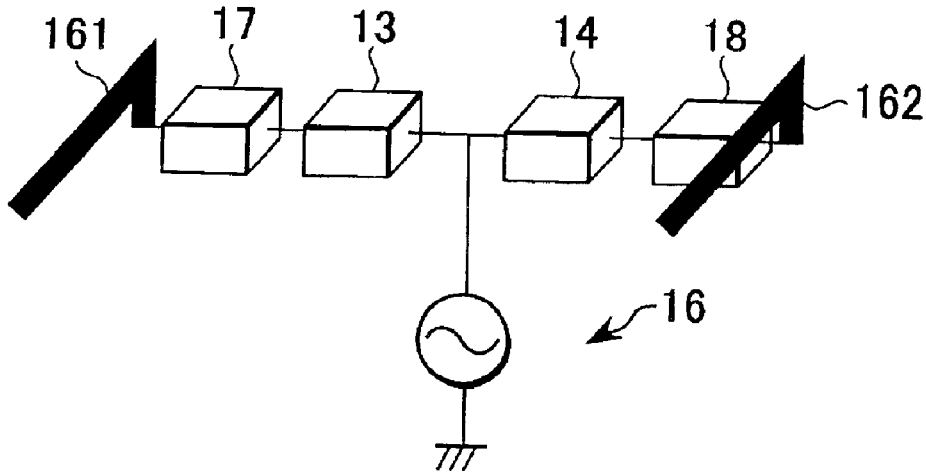
FIG. 20 is a diagram showing an inverted L pattern antenna as an example applicable to the antenna apparatus of the present invention.

Further, inverted L pattern antennae 161 and 162 shown in FIG. 20 are unbalanced antenna elements, and have a folded monopole antenna structure in order to realize a lower attitude. Normally, there are required additional connection of the matching circuits 17 and 18.

Figure 21:
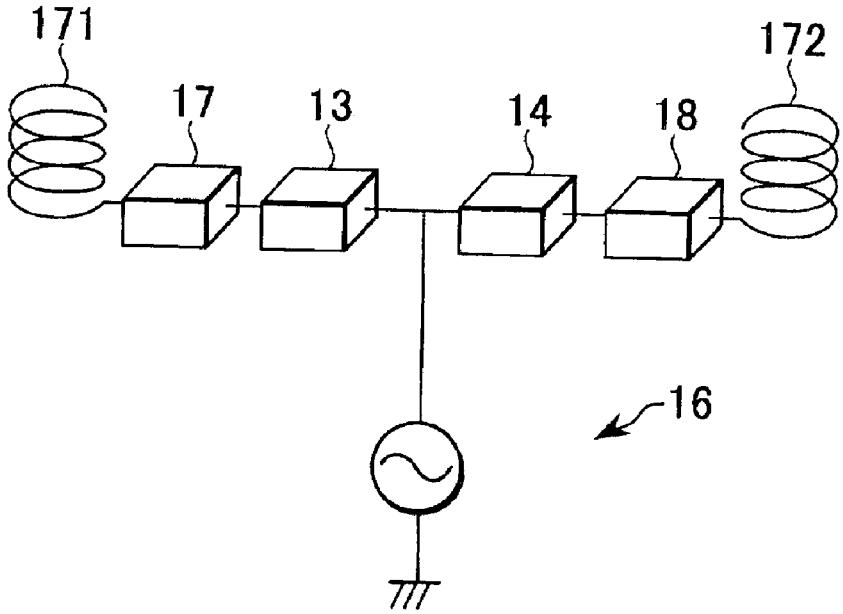
FIG. 21 is a diagram showing a helical antenna as an example applicable to the antenna apparatus of the present invention.

Still further, helical antennae 171 and 172 shown in FIG. 21 are unbalanced helical type antenna elements. They may be used as directional antennae or horizontal non-directional antennae depending on its helical diameter and length. Normally, they are used with the matching circuits 17 and 18 connected between each antenna element and its phase shift circuits 13 and 14.

As described heretofore, according to the antenna apparatus of the invention, because that the antenna elements are connected to the feed point via respective phase shift circuits so as to enable adjustment of the characteristic impedance of a given antenna element at the different resonance frequency of the other proximate antenna element and to eliminate the adverse effect between these antennae, operability of this antenna apparatus at different frequencies which are relatively proximate is enabled by provision of the antenna apparatus of the present invention which is realized in a simple configuration.

Further, according to the portable wireless communication apparatus provided with the antenna apparatus of the present invention, because that the antenna elements are connected to the feed point via respective phase shift circuits so as to enable adjustment of the characteristic impedance of a given antenna element at the resonance frequency of the other proximate antenna element and to eliminate adverse effects between these antennae, reception and transmission of radio waves with different frequencies, which are relatively proximate, are enabled by provision the antenna apparatus of the present invention realized in a simple configuration.

What is claimed is:

1. An antenna apparatus for receiving or transmitting radio waves, comprising:

a pair of antennas being one of a pair of (i) dipole antennas, (ii) loop antennas, (iii) plane inverted F pattern antennas or (iv) inverted L pattern antennas, having different resonant frequencies, each antenna in the one pair being operable at a time which is independent of the other, and a pair of phase shift circuits for shifting phase of said radio waves, wherein one of said phase shift circuits has positive phase shift characteristics and another has negative phase shift characteristics, and feed points of said pair of antennas are connected to a radio circuit via said pair of phase shift circuits, respectively, and whereby each of said antennas is operable to receive or transmit said radio waves at a different frequency.

2. The antenna apparatus according to claim 1, wherein: one of said phase shift circuits which are coupled to said one of said antennas shifts phase of said radio waves so as to increase an impedance of said one of said antennas at the resonance frequency of the other one of said antennas.

3. The antenna apparatus according to claim 1, wherein: said phase shift circuit comprises a lumped circuit.

4. The antenna apparatus according to claim 1, wherein: said phase shift circuit comprises a distributed constant circuit.

5. An antenna apparatus for receiving or transmitting radio waves, comprising:

a plurality of antennas being one of a pair of (i) dipole antennas, (ii) loop antennas, (iii) plane inverted F pattern antennas or (iv) inverted L pattern antennas having different resonant frequencies, each antenna in the one pair being operable at a time which is independent of the other; and a plurality of phase shift circuits for shifting phase of radio waves, wherein one of said phase shift circuits has positive phase shift characteristics and another has negative phase shift characteristics, and feed points of said plurality of antennas are connected to a radio circuit via said plurality of phase shift circuits, respectively, and whereby each of said antennas is operable to receive or transmit said radio waves at a different frequency.

6. The antenna apparatus according to claim 5, wherein: one of said phase shift circuits which are coupled to said one of said antennas shifts phase of said radio waves so as to increase an impedance of said one of said antennas at the resonance frequency of the other one of said antennas.

7. The antenna apparatus according to claim 5, wherein: said phase shift circuit comprises a lumped circuit.

8. The antenna apparatus according to claim 5, wherein: said phase shift circuit comprises a distributed constant circuit.

9. A portable wireless communication apparatus having an antenna apparatus for receiving or transmitting radio waves, said antenna apparatus comprising:

a plurality of antennas being one of a pair of (i) dipole antennas, (ii) loop antennas, (iii) plane inverted F pattern antennas or (iv) inverted L pattern antennas having different resonant frequencies, each antenna in the one pair being operable at a time which is independent of the other; and a plurality of phase shift circuits for shifting phase of said radio waves, wherein one of said phase shift circuits has positive phase shift characteristics and another has negative phase shift characteristics, and feed points of said plurality of antennas are connected to a radio circuit via said plurality of phase shift circuits, respectively, and whereby each of said antennas is operable to receive or transmit said radio waves at a different frequency.

10. The portable wireless communication apparatus according to claim 9, wherein:

said portable wireless communication apparatus is a portable telephone.

* * * * *